US006786782B1

(12) United States Patent
Robinson

(10) Patent No.: US 6,786,782 B1
(45) Date of Patent: Sep. 7, 2004

(54) PNEUMATICALLY OPERATED INLET WATER VALVE

(75) Inventor: Lawrence P. Robinson, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 66 days.

(21) Appl. No.: 10/295,720

(22) Filed: Nov. 15, 2002

(51) Int. Cl.[7] ..... B63H 21/10
(52) U.S. Cl. ..... 440/88 C; 440/88 M
(58) Field of Search ..... 440/2, 88 C, 88 M, 440/88 N; 114/183 R, 198

(56) References Cited

U.S. PATENT DOCUMENTS 4,176,630 A * 12/1979 Elmer ..... 123/41.12
4,177,971 A 12/1979 Landamore ..... 251/215
4,436,245 A * 3/1984 Nonnenmann et al. .... 236/49.4
4,513,696 A * 4/1985 Fujii et al. ..... 123/41.02
4,697,535 A 10/1987 Wileman, III ..... 114/183
5,947,047 A 9/1999 Sigler ..... 114/198
6,343,965 B1 2/2002 Biggs et al. ..... 440/88

* cited by examiner

*Primary Examiner*—Stephen Avila
(74) *Attorney, Agent, or Firm*—William D. Lanyi

(57) ABSTRACT

A pneumatically operated valve is provided for use in conjunction with a seacock, or in place of a seacock, so that flow of water through the hull of a marine vessel can be blocked more easily than by manually manipulating the lever of a standard seacock. A controller is provided at a convenient location so that the operator of a marine vessel can pressurize a pressure line which closes the pneumatically operated valve and blocks water flow through the seacock. A spring return can be used so that the pneumatically operated valve is urged toward an open position when pressure is not provided by the operator of the marine vessel. In certain embodiments, sensors can be provided so that an ignition system can not be actuated when the pneumatically operated valve of the present invention is in a closed position.

19 Claims, 5 Drawing Sheets

PNEUMATICALLY OPERATED INLET WATER VALVE

BACKGROUND OF THE INVENTION

1. Field of the Invention

The present invention generally relates to a pneumatically operated seacock and, more particularly, to a pneumatically operated valve for opening and closing an inlet water passage through the hull of a boat for providing cooling water to an engine cooling system.

2. Description of the Prior Art

Many different water management systems are well known to those skilled in the art of marine vessel designs. It is also well known to provide a conduit and valve, or seacock, that allows water to pass upwardly or inwardly through the hull of a marine vessel to provide water for various purposes. These purposes can include the provision of water for use in toilets, sinks, and showers. The purpose can also include providing cooling water for a cooling system of a marine propulsion device used to power the marine vessel.

U.S. Pat. No. 5,947,047, which issued to Sigler on Sep. 7, 1999, describes a seacock interlocking system. A boat has a seacock operatively attached to the hull and movable between open and closed positions. The seacock is operatively connected to a discharge pump, which in turn is connected to a sewage holding tank. An electrical switch is actuated in response to the position of the seacock, and control circuitry is connected to the seacock electrical switch and the discharge pump to prevent operation of the pump if the seacock is closed or in any position aside from fully open. An indicator, such as one or more light emitting diodes, is also actuated in response to the seacock electrical switch position, and another indicator, such as one or more light emitting diodes, is connected to the discharge pump and indicates when that pump is operating. The electrical switch is waterproof and meets marine vessel ignition prevention and electromagnetic compatibility requirements, and typically is actuated in response to the position of a manually actuable handle of the seacock.

U.S. Pat. No. 4,177,971, which issued to Landamore on Dec. 11, 1979, describes a seacock valve. A valve comprising a hollow cylindrical body with a valve opening at one end and a valve seat around the valve opening is described. A valve member is movable towards and away from the valve seat in a spindle which passes through a spindle opening opposite the valve opening. A handle is provided on the outer end of the valve spindle and has a screw threaded counterbore which is engageable with a screw threaded spigot on the outside of the valve around the spindle opening to hold the valve member in the closed position. In this position the end face of the valve member is flush with the outside of the valve around the valve opening. The upper side of the valve member has a screw threaded counterbore engageable with a screw treaded spigot on the inside of the valve around the spindle opening to hold the valve in the open state and form a seal around the spindle.

U.S. Pat. No. 4,697,535, which issued to Wileman, III on Oct. 6, 1987, describes a marine safety system. The system comprises a first switch adapted to be activated by rising water in a ship's hull, and solenoid valves adapted to be operated by the switch and adapted to close seacocks in the hull of the ship in a preferred sequence.

U.S. Pat. No. 6,343,965, which issued to Biggs et al on Feb. 5, 2002, discloses a pneumatically actuated marine engine water drain system. The drain system for a marine vessel is provided which includes one or more pressure actuated valves associated with the coolant water drain system. The boat operator is provided with a pressure controller that allows pressure to be introduced into the system for the purpose of actuating the drain valves and, as a result, opening various drain conduits to allow cooling water to drain from the engine cooling system into the bilge or overboard.

The patents described above are hereby expressly incorporated by reference in the description of the present invention.

Certain types of marine vessels, such as inboard drives, are typically provided with one or more seacocks to allow water to flow inwardly through an opening in the hull of the marine vessel to supply water to various components, such as the cooling system of a marine engine. A common type of seacock is manually operable and comprises a ball valve that is rotatable about an axis in response to the manual movement of an external lever. Since the seacock is typically positioned in the bilge and close to the inside surface of the marine vessel's hull, it is often in a very difficult location to access. It would therefore by significantly beneficial if a system could be provided that would allow the operator of a marine vessel to cause the seacock to open or close without having to physically access the seacock in the bilge of the marine vessel.

SUMMARY OF THE INVENTION

A water management system for a marine vessel, made in accordance with the preferred embodiment of the present invention, comprises a water conduit which is connectable in fluid communication with a passage extending through a hull of the marine vessel. It also comprises a pressure actuated valve disposed in fluid communication with the water conduit. A controller is connected in fluid communication with the pressure actuated valve and a pressure conduit is connected in fluid communication between the pressure actuated valve and the controller. The controller has an inlet for introducing pressure into the pressure conduit. In a particularly preferred embodiment of the present invention, the controller and the inlet are placed at a convenient location where the operator of a marine vessel can easily provide pressure into the pressure conduit for the purposes of actuating or deactuating the pressure actuated valve. Depending on the intended application of the present invention, the pressure actuated valve can comprise a spring return that results in the valve either being normally opened or normally closed.

The controller comprises an internal manifold connected in fluid communication with the pressure conduit and a pressure indicator for indicating a change in pressure within the pressure conduit. The present invention can further comprise an engine having an internal cooling system within a block of the engine, with the water conduit being connected in fluid communication with the internal cooling system. The pressure actuated valve can be a seacock or, alternatively, it can be connected in serial fluid communication with a seacock. The pressure actuated valve can be a pneumatically controlled valve. In one embodiment of the present invention, the controller is configured to be provided with pressure from a manually operated pump, such as a bicycle pump. The manual pump can operate as a source of pressure which is connected in fluid communication with the controller. A pressure relief mechanism is connected in fluid communication with the controller so that the operator of a marine vessel can easily and quickly release pressure from the present invention and, as a result, deactuate the pneumatically operated valve. The pressure relief mechanism is manually actuated to relieve pressure within the controller and the pressure conduit in order to deactivate the pressure actuated valve.

A particularly preferred embodiment of the present invention can further comprise a cooling water manifold having internal passages and connected in fluid communication with the internal cooling system within the block of the engine. The cooling water manifold is disposed below the level of the lowest portion of the internal cooling system which normally retains cooling water when the engine is not operating. The pressure actuated valve comprises a pneumatic piston in a preferred embodiment. The pneumatic piston is alternatively moveable to a first position which prevents flow through the water conduit and a second position which allows flow through the water conduit.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
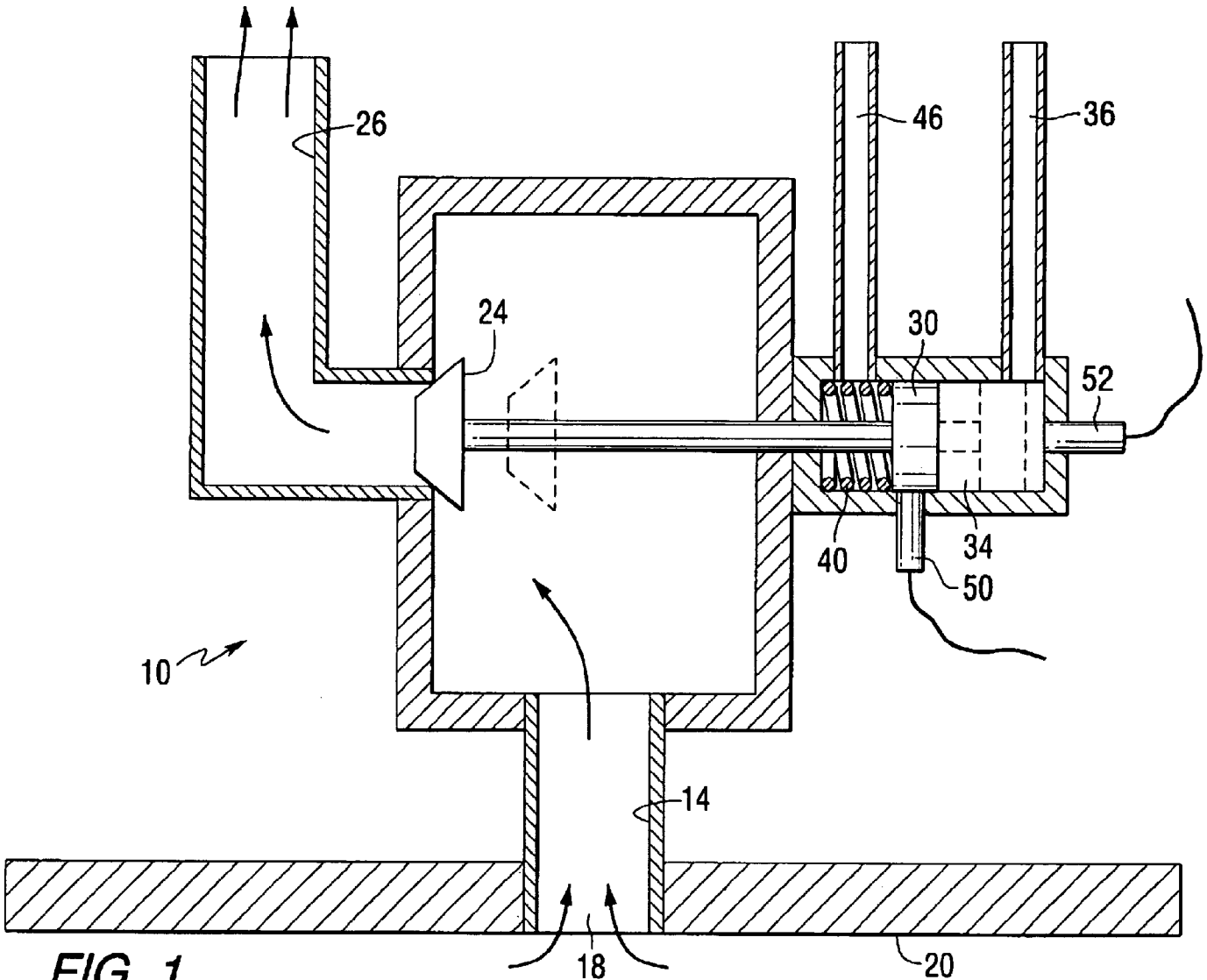
FIG. 1 is a simplified section view of a pneumatically actuated valve made in accordance with the present invention.

Throughout the description of the preferred embodiment of the present invention, like components will be identified by like reference numerals.

FIG. 1 shows the water management system 10 of the present invention. A water conduit 14 is connectable in fluid communication with a fluid passage 18 formed through the hull 20 of a marine vessel. A pressure actuated valve 24 is disposed in fluid communication with the water conduit 14. The pressure actuated valve 24 is moveable into a first position, as represented by solid lines in FIG. 1, which blocks flow of water through the water conduit 14 when it is in the first, or closed, position. When the pressure actuated valve 24 is moved to the second position, represented by dashed lines in FIG. 1, water can flow through the water conduit 14 and through a downstream portion 26 of the water conduit. The arrows in FIG. 1 represent the direction of water flow through the water conduit, 14 and 26, when the pressure actuated valve 24 is in the open position represented by dashed lines. A piston 30 is moveable within a cylinder 34 in response to changes in the relative pressure on the two sides of the piston 30. Increasing pressure in pressure conduit 36 urges the piston 30 toward the left in FIG. 1 and moves the pressure actuated valve 24 into a closed position as represented by solid lines in FIG. 1. A spring 40 is provided to urge the piston 30 toward the right in FIG. 1 and toward an open position of the pressure actuated valve 24, as represented by dashed lines. As will be described in greater detail below, a pressure sensing line 46 can also be provided so that the operator of a marine vessel can determine the open or closed position of the pressure actuated valve 24. Two sensors are also shown for determining the location of the piston 30. A first sensor 50 is positioned to sense the piston 30 when it is in a position associated with a closed position of the pressure actuated valve 24. Another sensor 52 is provided to sense the position of the piston 30 when it is in the position associated with an open position of the pressure actuated valve 24, as represented by dashed lines in FIG. 1. Although the embodiment in FIG. 1 comprises two sensors, 50 and 52, it should be understood that a single sensor could be used to either determine the position of the piston 30 in a closed position or an open position. Signals from these sensors can be used to provide an interlock with an ignition system, as will be described below.

The pneumatic drain system disclosed in U.S. Pat. No. 6,343,965, which is described above, shows various embodiments of a pneumatically operated valve used to drain cooling water from an engine into the bilge of a marine vessel. Similar components can be used in conjunction with the present invention which is intended to control the flow of water upwardly through the hull 20 of a marine vessel. When a seacock is used in conjunction with the cooling system of a marine engine, and the marine engine is being drained into the bilge of the marine vessel, a condition can arise in which water continually flows upwardly through the hull 20 of a marine vessel and into the engine's cooling system as water drains from the cooling system into the bilge. As water drains from the cooling system, it is then continually replenished by more water flowing upwardly through the seacock into the cooling system of the engine. Eventually, the bilge fills with water that flows through the circuit from the fluid passage 18 through the hull 20, through a seacock, into the cooling system of the engine, and eventually out through the draining system described in U.S. Pat. No. 6,343,965. This is particularly possible with marine vessels that use an inboard drive, such as a ski boat. Eventually, the bilge will fill with water and the boat can sink if the water circuit described is allowed to continue through the open seacock. Of course, the operator of the marine vessel should manually close the seacock prior to draining the engine through the use of a system such as that disclosed in U.S. Pat. No. 6,343,965. However, if the operator of the marine vessel fails to manually close the seacock prior to draining the engine with a system of that type or the seacock is inoperative, the bilge can fill with water flowing through the open seacock.

One of the primary purposes of the present invention is to provide an easy way by which the operator of the marine vessel can close or block the flow of water through the seacock without having to manually access the seacock which is often located in a position within the bilge that is difficult to reach. By providing a pneumatically operated valve, such as that shown in FIG. 1, the operator of the marine vessel can easily close the seacock or block flow through an external seacock when the engine draining procedure is about to begin.

Figure 2:
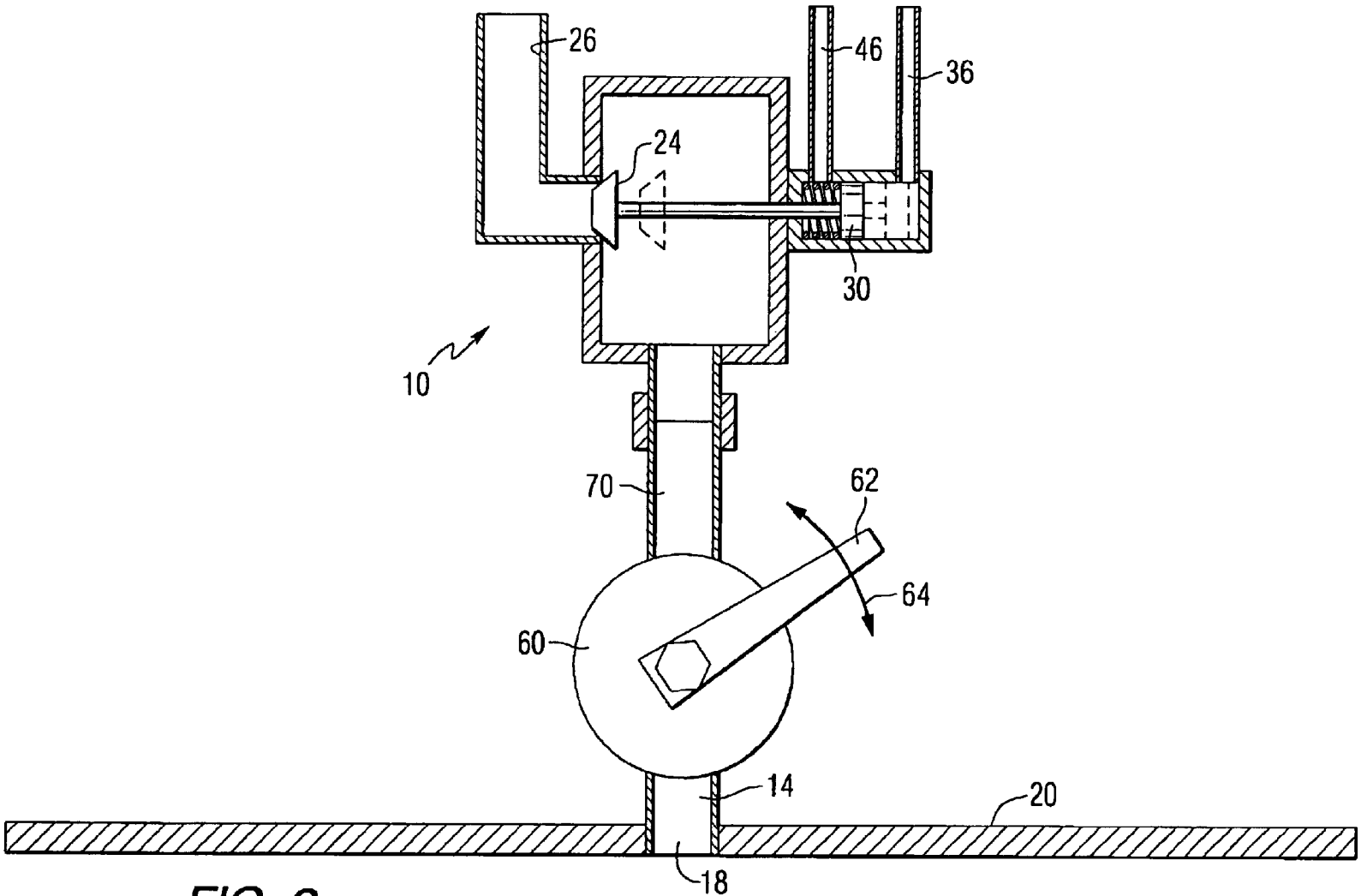
FIG. 2 shows the present invention used in conjunction with a standard seacock.

FIG. 2 shows the pneumatically operated valve 10 of the present invention connected in series fluid communication with a manually operated seacock 60. As is well known to those skilled in the art, the seacock 60 can comprise a ball valve within its internal structure. The ball valve is rotatable in response to movement of a manually operated handle 62, as represented by arrow 64. When the seacock 60 is closed, water is prevented from flowing through the fluid passage 18 which extends through the hull 20 of the marine vessel. In turn, this stops the flow of water through the water conduit 14. Typically, the conduit identified by reference numeral 70 in FIG. 2 is connected directed to a pump which pumps water from the conduit 14 into the cooling system of a marine engine. The water pumped through conduit 14 can also be provided for the toilet, shower, and other water consuming facilities of the marine vessel.

In FIG. 2, the pneumatically operated valve of the present invention is connected downstream from the seacock 60 and in series fluid communication with the seacock. The operation of the pneumatically controlled valve 10 in FIG. 2 is similar to the operation of the device illustrated in FIG. 1 and described above.

Figure 3:
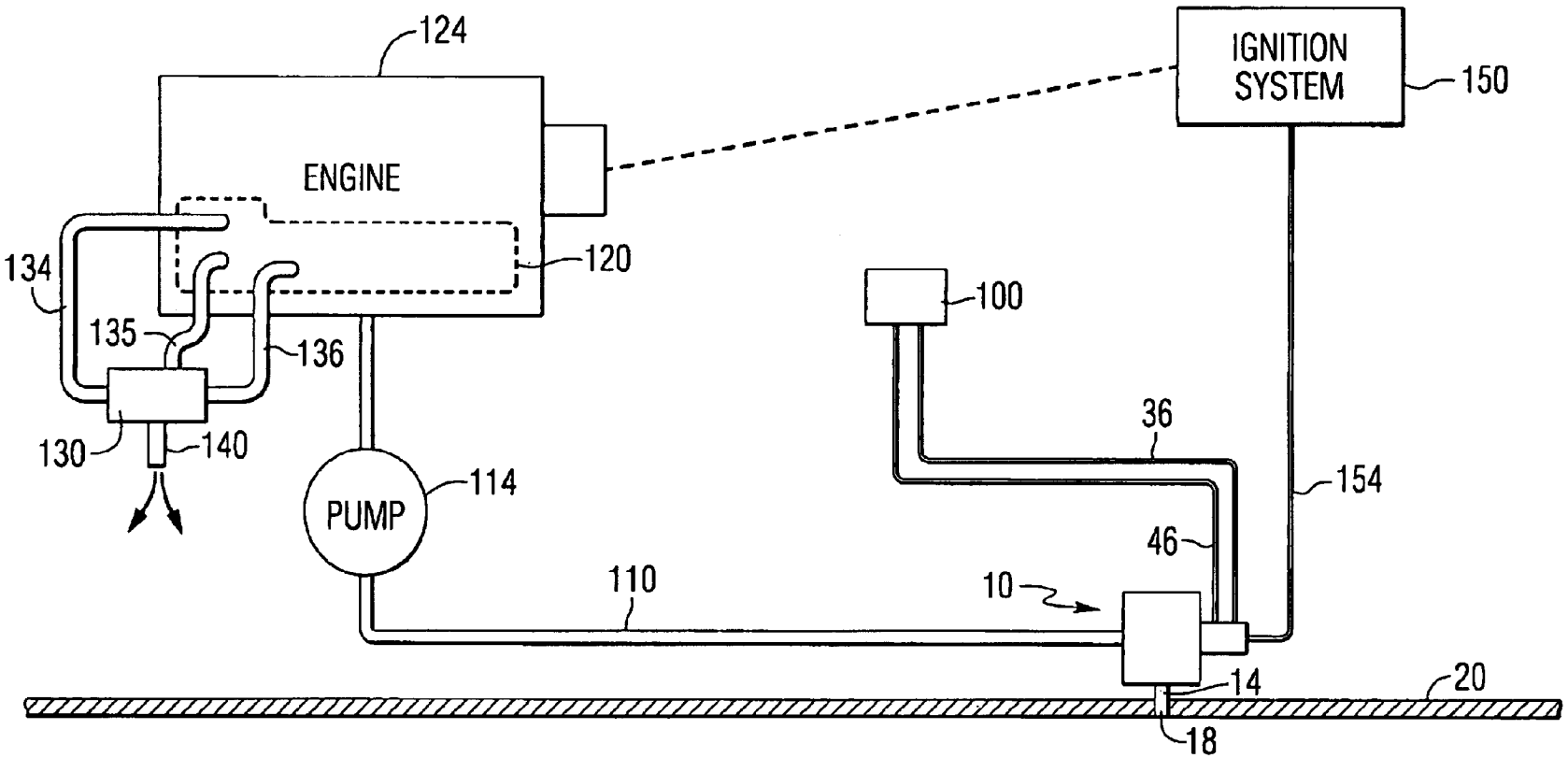
FIG. 3 shows a marine vessel engine used in conjunction with the present invention.

FIG. 3 shows the pressure actuated valve 10 of the present invention connected to a fluid passage 18 extending through the hull 20 of a marine vessel and the water conduit 14 of the present invention. It also shows the two pressure lines, 36 and 46, which are connected to a controller 100. Although FIG. 3 is schematic in nature, it should be understood that the controller 100 would be placed at a convenient location for access by the operator of the marine vessel when it is desired that the seacock be closed. When the pressure actuated valve 10 of the present invention is in an open condition, water is free to flow upwardly through the fluid passage 18 and the fluid conduit 14, through the pressure actuated valve 10, and through conduit 110 which is usually connected to a water pump 114 for pumping water into a cooling system 120 of an engine 124. For purposes of simplicity, the cooling system 120 is represented by a dashed line box in FIG. 3. The drain system for the engine, as described in detail in U.S. Pat. No. 6,343,965, comprises a cooling water manifold 130 and a plurality of drain conduits, 134–136, that allow water to be drained from the cooling system 120 of the engine 124 and into the cooling water manifold 130. From the cooling water manifold 130, the water is drained into the bilge of the marine vessel, as represented by the arrows flowing downward from a drain conduit 140 which is connected in fluid communication with the cooling water manifold 130. When the pneumatic draining system described in U.S. Pat. No. 6,343,965 is used in a marine vessel that is provided with a seacock, such as a ski boat, the water draining into the bilge, through drain conduit 140, is removed from the cooling system 120 and that water can be replaced by water flowing through fluid passage 18 and conduit 110 if the seacock remains open. If this occurs, the bilge of the marine vessel can be filled with water as described above.

With continued reference to FIG. 3, a preferred embodiment of the present invention can also incorporate an ignition system 150 that is connected in signal communication with one or more sensors, such as sensors 50 and 52 which are described above in conjunction with FIG. 1. This connection is provided by one or more electrical wires 154 which allow the ignition 150 to be interlocked with the pneumatically actuated valve 10 so that the ignition system 150 is prevented from starting the engine 124 when the pneumatically actuated valve 10 is in a closed position. Otherwise, the engine 124 can be caused to overheat because of a lack of cooling water flowing through the seacock.

Figure 4:
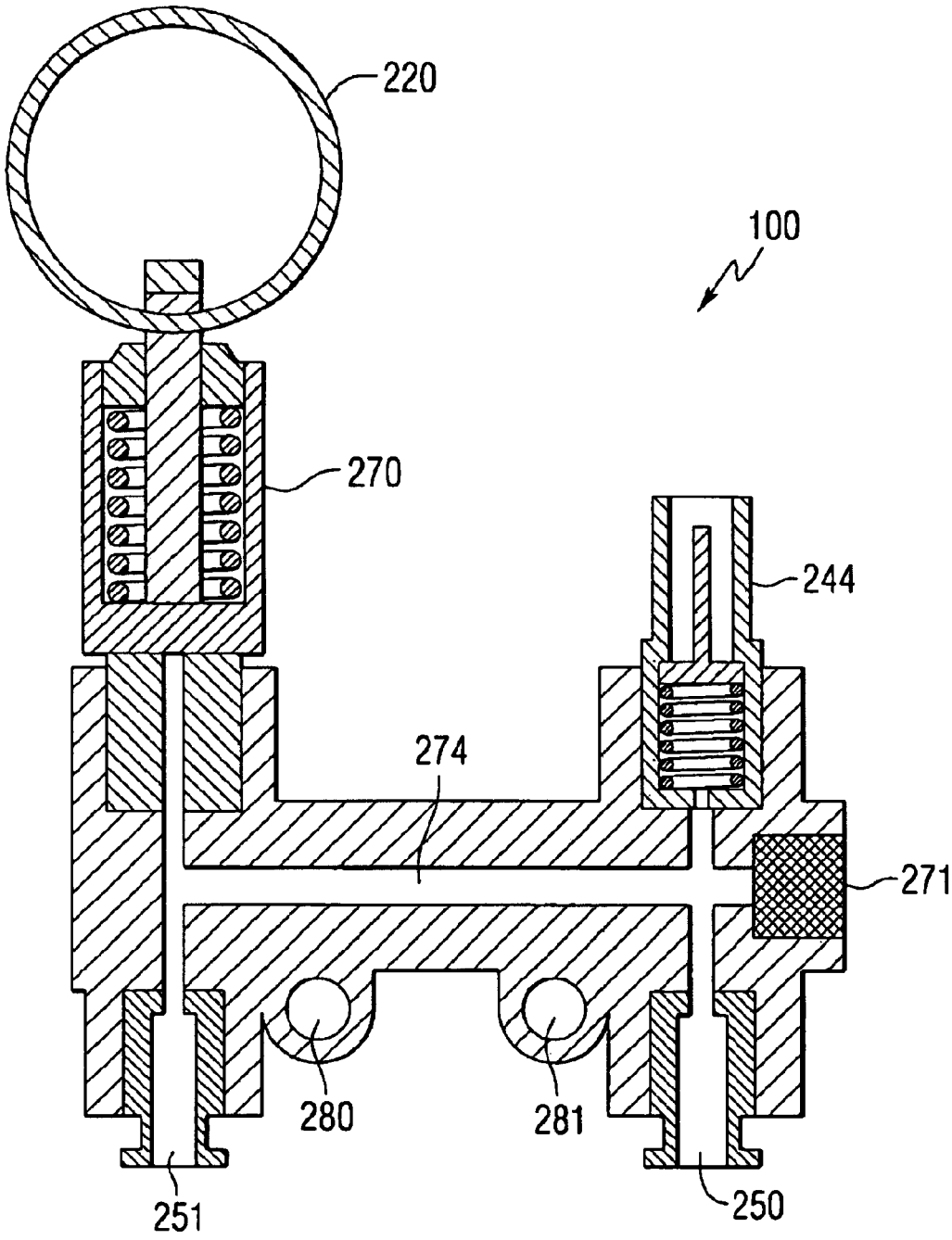
FIG. 4 PRIOR ART
FIG. 4 is a section view of a known type of controller used in conjunction with the present invention.

FIG. 4 shows a controller 100 that can be used in conjunction with the present invention. The controller 100 is similar to the controller described in U.S. Pat. No. 6,343,965, with reference to FIG. 7C in that patent. The controller 100 comprises a pressure relief valve 270 with a ring 220. A Schrader valve 244 allows the operator of the marine vessel to connect a source of pressure, such as a hand pump, to the Schrader valve 244 in order to pressurize the manifold 274 within the controller 100. Openings 250 and 251 are intended to be connected to pressure conduits which are, in turn, connected to pressure conduits associated with pneumatically actuated valves 10. It should be understood that plug 271 is provided to facilitate manufacturing. Holes 280 and 281 are provided to allow the controller 100 to be easily mounted at a convenient location for access by the operator of the marine vessel.

Figure 5:
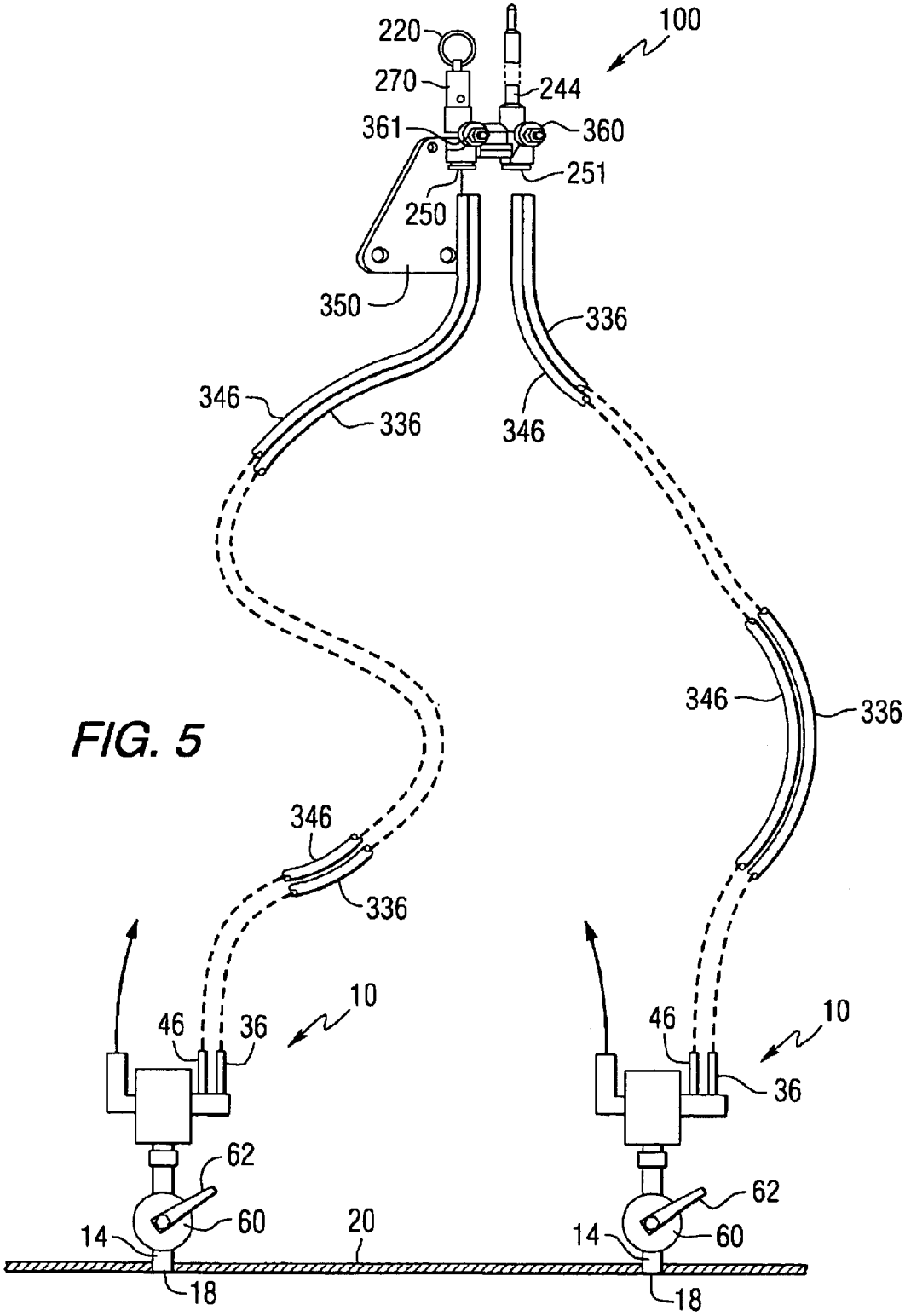
FIG. 5 shows two pneumatically controlled valves made in accordance with the present invention used in conjunction with a controller that is located at a convenient location for the operator of the marine vessel.

FIG. 5 illustrates the relationship between the controller 100 and one more pneumatically actuated valves 10 of the present invention. In FIG. 5, both pressure conduits, 36 and 46, are provided with pressure lines, 336 and 346, respectively. Pressure lines 336 are used to introduce pressure into the pneumatically actuated valve 10 to cause the piston 30 to move toward the left, as described above in FIG. 1. Pressure lines 346 are connected to pressure conduit 46 to allow pressure indicators, 360 and 361, to visually indicate the change in pressure to the operator of the marine vessel. The controller 100 is provided with a bracket 350 that allows the controller to be mounted at a convenient location for easy access by the operator of the marine vessel.

With reference to FIGS. 1-5, the water management system for a marine vessel made in accordance with the preferred embodiment of the present invention comprises a water conduit which is identified by reference numerals, 14, 26, 70, and 110 in the figures. This water conduit is connectable in fluid communication with a fluid passage 18 that extends through a hull 20 of a marine vessel. In a preferred embodiment of the present invention, this water conduit is connected to a pump 114 to provide cooling water to a cooling system 120 of an engine 124. However, alternate purposes, such as providing water toilets and sinks of a marine vessel, are also within the scope of the present invention. A pressure actuated valve 10 is disposed in fluid communication with the water conduit and a controller 100 is connected in fluid communication with the pressure actuated valve. By introducing pressure into an inlet of the controller, such as the Schrader valve 244, the operator of the marine vessel can pressurize the pressure line 336 and actuate the pneumatically actuated valve 24 to a closed position, as represented by solid lines in FIGS. 1 and 2. A pressure conduit, such as pressure conduit 36, is connected in fluid communication between the pressure actuated valve 10 and the controller 100. The controller has an inlet for introducing pressure into the pressure conduit 36, through pressure line 336. The controller 100 comprises an internal manifold 274 which is connected in fluid communication with the pressure conduit 36 and with a pressure indicator, such as pressure indicators 360 and 361, for indicating a change in pressure within the pressure conduit 36. This allows the operator of the marine vessel to ascertain that the pressure has been provided to the pressure actuated valve 10. If the pressure indicators are connected in fluid communication, through pressure lines 346, to pressure conduit 46, the pressure indicators also indicate actual movement of the piston 30 within its cylinder. The engine 124 has an internal cooling system 120 within a block of the engine and the water conduit 110 is connected in fluid communication with that internal cooling system 120. In some embodiments of the present invention, the pressure actuated valve 10 operates as a seacock and in other embodiments it is connected in serial fluid communication with a seacock 60. The pressure actuated valve, in a preferred embodiment, is a pneumatically controlled valve 10. The source of pressure can be a manually operated pump, such as a bicycle pump. The source of pressure can be connected in fluid communication with the inlet of the controller 100 which can be a Schrader valve 244. A pressure relief mechanism 270 can be manually actuated to relieve pressure within the controller 100, thereby deactivating the pressure actuated valve 10. A cooling water manifold 130 can be provided with internal passages and connected in fluid communication with the internal cooling system 120 of the engine 124. The cooling water manifold 130 can be disposed below the level of the lowest portion of the internal cooling system 120 which normally retains cooling water when the engine is not operating. The pressure actuated valve 10 can comprise a pneumatic piston 30 which is alternatively moveable to a first position which prevents flow through the water conduit and a second position which allows flow through the water conduit.

Whenever the operator of the marine vessel desires to prevent water flow through the seacock, the Schrader 244 would be pressurized in order to actuate the pneumatically actuated valve 10, which blocks flow through the present invention. When used in conjunction with a pneumatically actuated drain system, such as that described and claimed in U.S. Pat. No. 6,343,965, the present invention would be actuated prior to actuating the pneumatically operated drain system. Then, when water drains from the cooling system 120 of the engine 124 into the bilge of the marine vessel, water will not be drawn upwardly through the fluid passage 18 to replace the water removed from the cooling system 120.

Although the present invention has been described with particular specificity and illustrated to show a preferred embodiment, it should be understood that alternative embodiments are also within its scope.

I claim:

1. A water management system for a marine vessel, comprising:

a water conduit which is connectable in fluid communication with a fluid passage extending through a hull of said marine vessel;

a pressure actuated valve disposed in fluid communication with said water conduit;

a controller connected in fluid communication with said pressure actuated valve; and a pressure conduit connected in fluid communication between said pressure actuated valve and said controller, said controller having an inlet for introducing pressure into said pressure conduit, said controller comprising an internal manifold connected in fluid communication with said pressure conduit and a pressure indicator for indicating a change in pressure within said pressure conduit.

2. The system of claim 1, further comprising:

an engine having an internal cooling system within a block of said engine, said water conduit being connected in fluid communication with said internal cooling system.

3. The system of claim 1, wherein:

said pressure actuated valve is a seacock.

4. The system of claim 1, further comprising:

a seacock connected in serial fluid communication with said pressure actuated valve.

5. The system of claim 1, wherein:

said pressure actuated valve is a pneumatically controlled valve.

6. The system of claim 1, wherein:

said source of pressure is a manually operated pump.

7. The system of claim 1, further comprising:

a source of pressure connected in fluid communication with said controller.

8. The system of claim 1, further comprising:

a pressure relief mechanism connected in fluid communication with said controller.

9. The system of claim 8, wherein:

said pressure relief mechanism is manually actuated to relieve pressure within said controller and said pressure conduit to deactivate said pressure actuated valve.

10. The system of claim 1, further comprising:

a cooling water manifold having internal passages and connected in fluid communication with said internal cooling system within said block of said engine, said cooling water manifold being disposed below the level of the lowest portion of said internal cooling system which normally retains cooling water when said engine is not operating.

11. The system of claim 1, wherein:

said pressure activated valve comprises a pneumatic piston which is alternatively movable to a first position which prevents flow through said water conduit and a second position which allows flow through said water conduit.

12. A water management system for a marine vessel, comprising:

a water conduit which is connectable in fluid communication with a fluid passage extending through a hull of said marine vessel;

a pneumatically controlled valve disposed in fluid communication with said water conduit;

a controller connected in fluid communication with said pneumatically controlled valve, a source of pressure being connectable in fluid communication with said controller;

a pressure conduit connected in fluid communication between said pneumatically controlled valve and said controller, said controller having an inlet for introducing pressure into said pressure conduit; and a pressure relief mechanism connected in fluid communication with said controller, said pressure relief mechanism being manually actuated to relieve pressure within said controller and said pressure conduit to deactivate said pneumatically controlled valve.

13. The system of claim 12, wherein:

said controller comprises an internal manifold connected in fluid communication with said pressure conduit and a pressure indicator for indicating a change in pressure within said pressure conduit.

14. The system of claim 13, wherein:

said source of pressure is a manually operated pump.

15. The system of claim 13, further comprising:

an engine having an internal cooling system within a block of said engine, said water conduit being connected in fluid communication with said internal cooling system; and a cooling water manifold having internal passages and connected in fluid communication with said internal cooling system within said block of said engine, said cooling water manifold being disposed below the level of the lowest portion of said internal cooling system which normally retains cooling water when said engine is not operating.

16. The system of claim 15, wherein:

said pressure activated valve comprises a pneumatic piston which is alternatively movable to a first position which prevents flow through said water conduit and a second position which allows flow through said water conduit.

17. A water management system for a marine vessel, comprising:

a water conduit which is connectable in fluid communication with a fluid passage extending through a hull of said marine vessel;

a pneumatically controlled valve disposed in fluid communication with said water conduit;

a controller connected in fluid communication with said pneumatically controlled valve, a source of pressure being connectable in fluid communication with said controller;

a pressure conduit connected in fluid communication between said pneumatically controlled valve and said controller, said controller having an inlet for introducing pressure into said pressure conduit;

a pressure relief mechanism connected in fluid communication with said controller, said pressure relief mechanism being manually actuated to relieve pressure within said controller and said pressure conduit to deactivate said pneumatically controlled valve; an engine having an internal cooling system within a block of said engine, said water conduit being connected in fluid communication with said internal cooling system; and a cooling water manifold having internal passages and connected in fluid communication with said internal cooling system within said block of said engine, said cooling water manifold being disposed below the level of the lowest portion of said internal cooling system which normally retains cooling water when said engine is not operating.

18. The system of claim 17, wherein:

said controller comprises an internal manifold connected in fluid communication with said pressure conduit and a pressure indicator for indicating a change in pressure within said pressure conduit.

19. The system of claim 18, wherein:

said pressure activated valve comprises a pneumatic piston which is alternatively movable to a first position which prevents flow through said water conduit and a second position which allows flow through said water conduit.

* * * * *